United States Patent [19]

Graff et al.

[11] Patent Number: 4,953,718

[45] Date of Patent: Sep. 4, 1990

[54] CLOTHES HANGING ASSEMBLY

[75] Inventors: James C. Graff; Frederick K. Robertson, both of Williamsburg, Va.

[73] Assignees: Paul B. Austin; Charles J. Graff, both of Williamsburg, Va.

[21] Appl. No.: 365,796

[22] Filed: Jun. 14, 1989

[51] Int. Cl.[5] ..... A47H 1/00

[52] U.S. Cl. ..... 211/123; 211/105.1

[58] Field of Search ..... 211/123, 105.1, 113, 211/118, 119, 153; 206/278, 341, 486, 490

[56] References Cited

U.S. PATENT DOCUMENTS

| | | | |
|---|---|---|---|
| D. 177,639 | 5/1956 | Nikkel . | |
| 1,462,803 | 7/1926 | Deserty . | |
| 1,996,552 | 4/1935 | Schwender . | |
| 2,488,582 | 11/1949 | Cinamon . | |
| 2,699,263 | 1/1955 | Ore | 211/113 |
| 2,805,780 | 9/1957 | Brennan | 211/105.1 X |
| 2,868,389 | 1/1959 | Friend | 211/123 |
| 2,893,545 | 7/1959 | Garfunkel | 211/123 |
| 2,993,602 | 7/1961 | Zeman et al. | 211/123 |
| 3,120,309 | 2/1964 | Goettl . | |
| 3,482,746 | 12/1969 | Ferguson . | |
| 3,961,734 | 6/1976 | Threeton . | |

*Primary Examiner*—Ramon S. Britts
*Assistant Examiner*—Sarah A. Lechok
*Attorney, Agent, or Firm*—Wallace J. Nelson

[57] ABSTRACT

A clothes hanger assembly is disclosed and includes a clothes hanger support bar 12 having a top surface 16, a bottom surface 15 and first and second side surfaces 11 and 21 respectively. The top surface is disposed in abutting relationship and attached at each end to a closet shelf 14 via bolts 17 and nuts 18. A plurality of elongated concave grooves 20 are disposed at spaced equal intervals along a first side surface 11 of support bar 12 and stop short of the top surface 16 thereof. Each groove 20 merges with a slightly tapered bore 22 extending angularly downward through hanger support bar 12, emerging on the second side surface and, short of the bottom surface thereof. Each tapered bore 22 is adapted to receive a clothes hanger 24 therein. Each hanger 24 includes a conventional transverse bar, or other conventional hanging structure, (not shown) for supporting trousers etc., and a pair of arms **25, 25*a* angularly extending from the transverse bar to merge with a vertical section 26. Vertical section 26 merges with an angular hook 28 that is received by and frictionally retained within tapered bore 22. Hanger support bar 12 may be formed of metal, wood, or molded or extruded plastics and of a single or multiple lengths for attachment to closet shelf 24.**

9 Claims, 1 Drawing Sheet

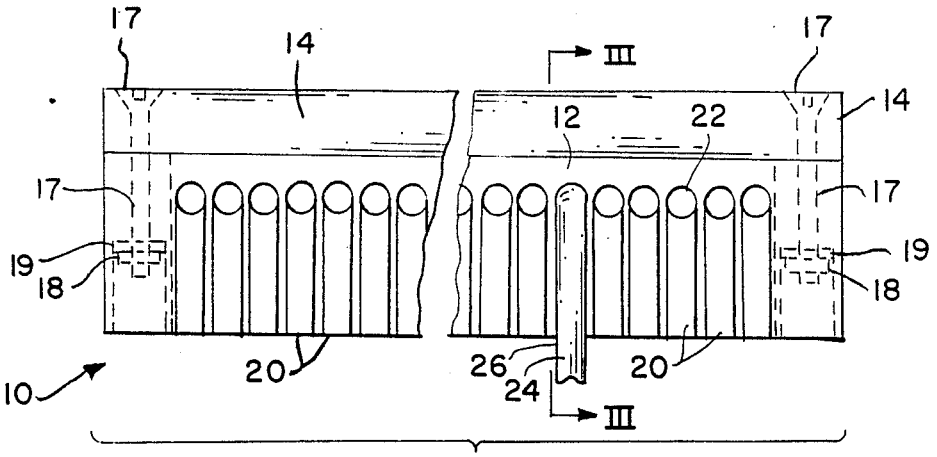
FIG. 1
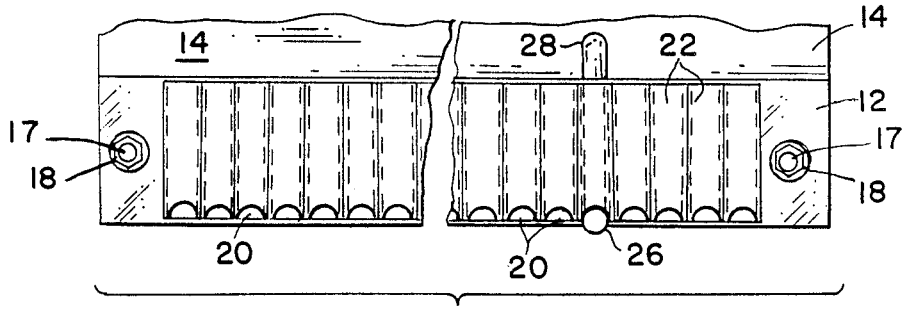
FIG. 2
FIG. 3
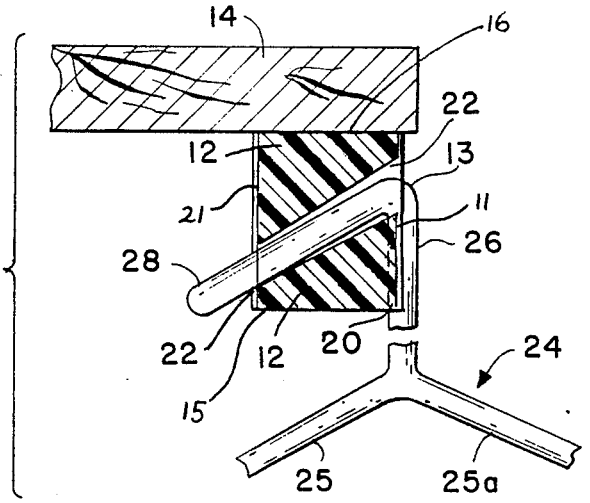

CLOTHES HANGING ASSEMBLY

FIELD OF THE INVENTION

This invention relates to a clothes hanger assembly in general, and relates specifically to a clothes hanger support bar attached to a closet shelf and specifically structured hangers therefor to permit hanging of multiple garments in spaced relationship and thereby prevent relative horizontal garment movement and subsequent wrinkling of the garments.

BACKGROUND OF THE INVENTION

Most clothes hanger bars for clothes closets are nothing more than cylinderical rod elements that permit the upper hook portion of a clothes hanger to be slidably positioned thereon. While this is satisfactory for most apparel, some garments such as expensive men and ladies suits, and other fine apparel, do not retain their preferred shape and appearance when compressed against or between other garments for extended periods of time. In addition, the quality of finer garments often give them a greater weight which often bends the hanger hook and/or causes the clothes to fall. Various spacer elements have been previously employed but these generally require expensive construction for the spacer elements and these modified hanger systems, thus far, have not proven satisfactory. Thus, there is a definite need in the art for an improved, economical, yet stronger, clothes hanger assembly that will permit hanging of multiple garments in fixed spaced relationship such that the closet space is utilized in a more efficient manner, garments are prevented from relative horizontal movement and pressing against each other and the accessibility to the user's wardrobe is improved.

Accordingly, it is an object of the present invention to provide a novel clothes hanger support bar and hanger combination that is economical to produce and easily installed by the builder or home owner.

Another object of the present invention is a modular hanger assembly that will tailor itself easily to large and small closets.

A further object of the present invention is a clothes hanger support bar that supports a plurality of clothes hangers in spaced relationship with relative horizontal movement between the hangers being prevented.

Another object of the present invention is a novel clothes hanger support bar and hanger combination that is readily attachable to a closet shelf and provides additional strength to the shelf.

A further object of the present invention is a clothes hanger support bar that prevents garments hung thereon from being crushed by adjacent hanging garments.

An additional object of the present invention is a clothes hanger support assembly that improves the efficient utilization of closet space while also providing a better visual display and accessibility of the clothes stored within the closet.

According to the present invention the foregoing and additional objects are attained by providing an elongated clothes hanger support bar having a top surface, a bottom surface and first and second side surfaces. The top surface of the support bar is disposed in abutting relationship and attached at each end to a closet shelf. A plurality of elongated grooves, having an arcuate or concave cross-sectional area and beginning at the bottom surface and extending toward but stopping short of the top surface of the hanger support bar, are disposed in spaced relationship along the first side surface of the hanger bar. Each groove merges with a slightly tapered bore extending from the first side surface and exiting on the second side surface of the hanger support bar while angling toward, but stopping short of, the bottom surface thereof.

A plurality of clothes hangers, each having a vertically extending neck portion and an angularly directed tip integrally extending from the neck portion, are provided, one each, for the vertically extending concave grooves and angularly directed bores. The hanger neck portions rest in the vertically extending concave grooves with the angular tips being received and extending through the tapered angular bores in the hanger support bar. These grooves and bores maintain the hangers spaced from each other and are prevented from moving horizontally relative to each other to protect clothing supported thereon from becoming wrinkled or mis-shaped due to compressive forces from adjacent clothing. When greater isolation a garment or when a garment bag is employed, the grooves on either side thereof may be left vacant if so desired.

BRIEF DESCRIPTION OF THE DRAWINGS

A more complete appreciation of the invention and many of the attendant advantages thereof will be readily apparent as the same becomes better understood with reference to the following detailed description when considered in connection with the accompanying drawings wherein:

FIG 1 is a front view of the clothes hanger bar attached to a closet shelf according to the present invention:

FIG. 2 is a bottom view of the clothes hanger bar shown in FIG 1; and

FIG. 3 is a part sectional view of the clothes hanger support bar and shelf of the present invention and taken along line III—III of FIG. 1.

DETAILED DESCRIPTION OF THE PREFERRED EMBODIMENTS

Referring now to the drawings, the clothes hanger support system according to the present invention is shown and designated generally by reference numeral lo. Support system lo includes an elongated clothes hanger support bar 12 attached to a closet shelf 14 via a pair of bolts 17 and threaded nuts 18. A lock washer 19 is positioned on each bolt 17 to assist in maintaining nuts 18 thereon.

Hanger support bar 12 is provided with a plurality of vertically extending concave grooves 20 spaced at equal intervals along a first side surface 11 thereof. Grooves 20 extend from the bottom surface 15 of hanger support bar 12 and stop short of the top surface 16 thereof. Each groove 20 merges with a slightly tapered bore 22. Each bore 22 extends angularly downward through hanger support bar 12 and emerges on a second side surface 21 thereof short of the bottom surface 15 of the support bar.

Each tapered bore 22 is adapted to receive a clothes hanger 24 therein, with only one hanger being illustrated in the interest of clarity. Hanger 24 includes a conventional transverse bar, and/or other conventional hanging structure. (not shown}for supporting trousers, slacks, lingerie, ties and the like. A pair of arms 25,25a angularly extend from the transverse bar to merge with a vertical section 26 on hanger 24. Vertical section 26 merges with an angular hook 28 serving as the tip of hanger 24. As shown in FIG. 3, hook section 28 is received through tapered angular bore 22, while vertical section 26 rests in a vertically extending groove 20 on support bar 12. As discussed hereinbefore, each angular bore 22 is provided with a tapered cross-sectional area with the enlarged end thereof disposed adjacent the first surface 11 of hanger support bar 12 and merging with a vertically extending groove 20. This enlarged end permits easy insertion of angular hook 28 of hanger 24 therein. The small end of tapered bore 22 opens on the second or opposite side 21 of hanger support bar 12 and serves to receive the end of hook section 28 of hanger 24 therethrough. This tapered construction assists in frictionally retaining hook section 28 within bore 22. The frictional assistance is increased in proportion to the weight of the item hung on hanger 24.

The operation and use of the present invention is now believed apparent Hanger support bar 12 may be formed of any material suitable for the purpose including cast or machined metal, e.g., aluminum and aluminum alloys, wood, and molded or extruded plastics. In the illustrated embodiment, hanger support bar 12 was a rectangular bar having top and bottom surfaces of one and one-quarter inches and first and second side surfaces of one and one half inches. This support bar 12 was formed of molded polyvinyl chloride with the bores and grooves therein formed in the molding process. When employing wood or metal stock for bar 12, the material would be milled, cast or machined to the proper configuration and dimensions, as so desired. Different lengths of hanger support bar 12 may also be utilized without departing from the teachings of the present invention. For example, the length of hanger support bar 12 may be twelve inches with multiple bars being employed on a shelf having a longer length. Thus, for a thirty-six or forty-eight inch shelf, three or four of the twelve inch sections, respectively, would be employed. Also, hanger support bar 12 may be formed of a single section that is thirty-six inches, forty eight inches or a different length, as so desired. When employing long lengths, additional attachment bolts may be disposed in the center or at other stations along the length of support bar 12. Also, more than one transverse bar or supportive hooks on the underside of angular arms 25,25*a* may be employed when so desired.

Hangers 24 may be constructed of any suitable metal, wire, wood, plastics, composites or equivalent materials. In the illustrated embodiment hangers 24 were molded polyvinyl chloride, circular in cross section, and having a sixteen inch transverse bar and a vertical height of five and one-half inches from the transverse bar to the beginning of vertical section 26. The length of vertical section 26 was three inches with angular hook 28 extending approximately two inches, and at a thirty degree angle, from vertical section 26. The diameter of a section of hanger 24, in a specific embodiment, was one-quarter inch and the depth of concave grooves 20 was equal to one-half of this or one-eighth inch. The opening of tapered bore 22 merging with concave groove 20 was five-sixteenths of an inch and tapering to one-fourth of an inch at the end thereof opening on the second side surface of hanger support bar 12. These dimensions are not critical and would obviously vary upon changes in the materials employed and changes in the diameter of clothes hangers 24. The essential feature being that the small end of tapered bore 22 is essentially the same diameter as, but permits the receipt of. the end of angular hook 28 in frictional engagement therewith.

For installation, either by the home owner or by the builder, suitable holes are bored in shelf 14, to mate with the transverse openings provided in support bar 12, and countersunk bolts 17 inserted therein. Lock washers 19 are then applied to bolts 17 and nuts 18 threadingly tightened thereon to firmly attach the clothes hanger support bar 12 to shelf 14. The concave grooves 20 along the length of support bar 12 tend to limit the flexibility thereof and assist in support bar 12 providing additional strength to shelf 14. When the length of the hanger support bar segment 12 is shorter than shelf 14, additional support bar segments may be employed, as discussed hereinbefore.

It is thus seen that the present invention provides a novel clothes hanger support system that permits hanging of multiple garments in spaced relationship without the danger of individual garments being crushed or wrinkled by adjacent garments.

Although the invention has been described relative to a specific embodiment thereof, it is not so limited and there are numerous variations and modifications thereof that will be readily apparent to those skilled in the art in the light of the above teachings.

It is therefore to be understood that the invention may be practiced other than as specifically described herein without departing from the spirit and scope of the appended claims.

What is claimed as new and desired to be secured by Letters Patent of United States is:

1. A clothes hanging assembly comprising in combination:

a clothes hanger support bar having a top surface, a bottom surface and a first and a second side surface, a plurality of spaced, vertically extending, grooves extending from said bottom surface along said first side surface to a point thereon short of said top surface, each said vertically extending groove merging with an angularly directed through opening leading from said first side surface downwardly through said second side surface at a point short of said bottom surface.

a plurality of clothes hangers, each having a vertical section thereon received by one of said vertically extending grooves and a hook section extending from said vertical section at an acute angle thereto and mating with, and releasably retained by, said angularly directed through opening to thereby permit hanging of clothes on said hanger in spaced adjacency relative to each other while preventing relative horizontal movement thereof.

2. The combination of claim 1 including a closet shelf having opposite ends and means for attaching said clothes hanger support bar to said closet shelf.

3. The combination of claim Z wherein said means for attaching said clothes hanger support bar to said closet shelf includes a bolt extending through each said end of said shelf and said clothes hanger support bar and a nut threadingly received on each said bolt.

4. The combination of claim 1 wherein said angular hook on said clothes hanger is bent at an angle approximately 30° with respect to said vertical section of said hanger.

5. The combination of claim 1 including each said angular directed through opening leading from said first side surface to said second side surface is provided with a slight taper interior cross-sectional area such that the open area thereof adjacent said first side surface is larger than said angular hook section of each said clothes hanger and the cross-sectional area of said angularly directed through opening adjacent said second side surface is essentially the same size as said angular hook section of each said clothes hanger to thereby permit easy entry of said hook section into said angular directed through opening while also assisting in frictional retention of said hook section when positioned therein.

6. In combination:

an elongated clothes hanger support bar adapted to be installed in a clothes closet and having a top surface, a bottom surface and a first and a second side surface, retention means on and extending through said clothes hanger support bar adapted to receive a plurality of clothes hangers in frictionally retained relationship therewith, said retention means including a plurality of spaced vertical grooves formed in said first side surface and an equal number of angularly directed through openings merging with said plurality of grooves and leading from said first side surface downwardly through said second side surface at a point short of said bottom surface, and a plurality of clothes hangers equal in number to said vertical grooves with each of said plurality of clothes hangers having a vertical section received in one of said vertical grooves and a hook end integral with and extending from said vertical section at an acute angle thereto and positioned within said angularly directed through opening.

7. The combination of claim 6 and further including said angular hook end of each said clothes hanger being disposed at an angle approximately 30° with respect to said clothes vertical section of said hanger.

8. The combination of claim 6 and further including a closet shelf having opposite ends and means for attaching said elongated clothes hanger bar to said closet shelf.

9. The combination of claim 8 wherein said means for attaching said elongated clothes hanger bar to said closet shelf includes at least one bolt member received through each said end of said closet shelf and said clothes hanger bar and a nut threadingly received on each said bolt member.

* * * * *

UNITED STATES PATENT AND TRADEMARK OFFICE

CERTIFICATE OF CORRECTION

PATENT NO. : 4,953,718

DATED : September 4, 1990

INVENTOR(S) : Graff et al

It is certified that error appears in the above-identified patent and that said Letters Patent is hereby corrected as shown below:

On the title page:

Item [73] Assignees: should read --Paul E. Austin; Charles J. Graff, both of Williamsburg, VA. (part interest)

Signed and Sealed this

Fourth Day of February, 1992

*Attest:*

HARRY F. MANBECK, JR.

*Attesting Officer*

*Commissioner of Patents and Trademarks*